US010524583B2

(12) United States Patent
Fischer et al.

(10) Patent No.: US 10,524,583 B2
(45) Date of Patent: Jan. 7, 2020

(54) MATTRESS PROTECTOR WITH IMPROVED MOISTURE MANAGEMENT AND BED BUG CONTAINMENT

(71) Applicant: American Textile Company, Duquesne, PA (US)

(72) Inventors: Jane Fischer, Mooresville, NC (US); Cathy Hartnett, Duquesne, PA (US)

(73) Assignee: American Textile Company, Inc.

( * ) Notice: Subject to any disclaimer, the term of this patent is extended or adjusted under 35 U.S.C. 154(b) by 487 days.

(21) Appl. No.: 15/189,113

(22) Filed: Jun. 22, 2016

(65) Prior Publication Data

US 2017/0367490 A1 Dec. 28, 2017

(51) Int. Cl.

*A47C 31/00* (2006.01)
*A47C 27/00* (2006.01)
*A47G 9/00* (2006.01)

(52) U.S. Cl.

CPC ..... *A47C 31/007* (2013.01); *A47C 27/005* (2013.01); *A47G 9/007* (2013.01); *A47G 2009/001* (2013.01)

(58) Field of Classification Search

CPC ..... A47C 31/00
USPC ..... 5/482, 487, 490, 499, 502
See application file for complete search history.

(56) References Cited

U.S. PATENT DOCUMENTS 7,552,489 B2 6/2009 Bell et al.
8,087,111 B2 1/2012 Paris
8,359,688 B2 1/2013 Murphy et al.
8,413,276 B2 4/2013 Rattner et al.
8,429,777 B2 4/2013 Svoboda
8,434,175 B1 * 5/2013 Wright ..... A47C 31/105 5/499
8,516,633 B2 8/2013 Dobin
8,528,134 B2 9/2013 Bell et al.
8,615,826 B2 12/2013 Michael
8,806,678 B2 8/2014 Michael
8,938,824 B2 1/2015 Rensink et al.
2011/0041247 A1 * 2/2011 Moon ..... A47G 9/02 5/490
2011/0250409 A1 * 10/2011 Marte ..... D06M 11/79 428/195.1
2012/0117728 A1 * 5/2012 O'Neill ..... A47C 31/007 5/499
2012/0167301 A1 * 7/2012 Michael ..... A47C 31/007 5/482
2014/0352073 A1 * 12/2014 Goenka ..... D06M 23/00 5/691

(Continued)

*Primary Examiner* — Fredrick C Conley
(74) *Attorney, Agent, or Firm* — H. Jay Spiegel

(57) ABSTRACT

A mattress protector completely encloses a mattress to preclude bed bugs from escaping. All of the interior surfaces of the protector are coated or laminated with a film laminate that is resistant to bed bug bites. A zipper extends partially around the circumference of the mattress protector so that when the zipper is opened an opening is provided allowing a mattress to be slid into the protector. The zipper is located next to the intersection between side walls and the bottom wall. A closure flap extends perpendicularly to the direction of extension of the zipper. The outer surface of the top wall is provided with a coating that renders the top surface waterproof while also providing anti-microbial properties and unique temperature regulation.

20 Claims, 8 Drawing Sheets

(56) References Cited

U.S. PATENT DOCUMENTS

| | | | | |
|---|---|---|---|---|
| 2015/0056890 | A1* | 2/2015 | Black | A41C 3/0057<br>450/86 |
| 2015/0096120 | A1* | 4/2015 | Scarleski | A47C 31/105<br>5/484 |

* cited by examiner

MATTRESS PROTECTOR WITH IMPROVED MOISTURE MANAGEMENT AND BED BUG CONTAINMENT

BACKGROUND OF THE INVENTION

The present invention relates to a mattress protector with improved moisture management and bed bug containment. The art of bedding products is well developed including numerous products that are used in association with beds, mattresses, box springs, and other bed components.

A typical bed includes a frame, a headboard, a box spring, and a mattress supported on the box spring. Through human interaction, it is often the case that perspiration from persons using the bed is present on the mattress as well as on sheets and pillow cases. It would be advantageous if bedding products could incorporate a mechanism to manage the perspiration present on the bedding and mattress.

Additionally, the presence of moisture on the mattress, sheets, and pillow cases as well as blankets can provide a hospitable environment for the growth of bacteria which can cause discomfort, noxious odors, as well as proliferation of diseases. Prevention of bacterial growth in bedding would thus be an advantageous development as would blocking of allergens.

Sometimes, bed bugs are present in bed mattresses. Bed bugs are typically nocturnal and bite the human occupants of a bed while they are sleeping causing welts as well as potentially causing diseases to arise. An industry has developed in recent years concerning bedding products designed to prevent bed bugs from attacking human bed occupants. Bedding products to prevent bites from bed bugs are advantageous and take on a variety of forms.

To date, no bedding product has arisen, to Applicants' knowledge, that addresses all of these issues simultaneously, the issue of managing perspiration, the issue of depressing growth of bacteria, the issue of blocking allergens, and the issue of stopping bed bugs from biting the occupants of a bed. The goal of the present invention is to address all of these issues simultaneously so that a bed is a more hospitable place to sleep while at the same time deterring a bed from being a place where diseases caused by bacteria can advance.

Applicants are aware of Published Application No. US 2011/0250409 A1 to Marte et al., published Oct. 13, 2011. The underlying application Ser. No. 13/054,357 is abandoned. The invention disclosed in the Marte et al. Published Application was assigned to HeiQ mATERIALS ag. Marte et al. disclose a multi-functional, responsive functional layer on solid surfaces and the method for production thereof. The substances disclosed by Marte et al. include anti-microbial properties as well as the ability to coat fabrics and manage moisture on the fabrics. Applicants incorporate by reference the entirety of the disclosure of the Marte et al. Published Application.

Marte et al. disclose a responsive polymer that binds to water at lower body temperatures, i.e., less than 30° C., and that precipitates water at higher temperatures due to increasing insolubility. See paragraph [0076]. The entirety of the Marte et al. Published Application discloses use of the disclosed substances on a variety of types of apparel. The final paragraph before the proposed claims ([0127]) has a single sentence: "Other uses are cloths, tablecloths, tent tarps, films, bed linens, or a use as a water collector." This extremely brief disclosure of a potential use in association with bed linens does not in Applicants' view teach or suggest any specific manner of use of the substances disclosed nor how they are applied nor where they are applied on bedding products. The present invention, among other numerous features, incorporates substances such as those disclosed by Marte et al. as one component of the present invention, however, Applicants submit that the application of those substances in the manner disclosed herein is unobvious. The present invention is not, in fact, directed to "bed linens" but rather is directed to mattress protectors, a different product.

Mattress protectors that incorporate features to prevent bed bugs from escaping the mattress protector are generally known. The present invention incorporates a unique combination of features to enclose a mattress and prevent bed bugs from escaping the enclosure. Among the features incorporated in the present invention are a laminate covering all of the interior surfaces of the protector. A zipper is provided at a location where the side walls of the protector intersect the bottom wall. This location separates the zipper from the people sleeping on the bed to prevent abrasion from the zipper. The zipper facilitates opening and closing of the mattress protector, preferably around a portion of the circumference thereof. At the end of the zipper track where the mattress protector is completely closed, a flap is provided that extends perpendicular to the direction of extension of the zipper track and folds over the side wall of the mattress protector as well as extending over the bottom of the mattress protector.

Applicants are aware of the following U.S. Pat. No. 7,552,489 to Bell et al., U.S. Pat. No. 8,087,111 to Paris, U.S. Pat. No. 8,359,688 to Murphy et al., U.S. Pat. No. 8,413,276 to Rattner et al., U.S. Pat. No. 8,429,777 to Svoboda, U.S. Pat. No. 8,516,633 to Dobin, U.S. Pat. No. 8,528,134 to Bell et al., U.S. Pat. No. 8,615,826 to Michael, U.S. Pat. No. 8,806,678 to Michael, and U.S. Pat. No. 8,938,824 to Rensink et al.

Each of the patents listed in the prior paragraph discloses a mattress encasement or enclosure that includes zipper features designed to preclude bed bugs from escaping the protector or enclosure. A variety of structures are disclosed but none of them includes the combination of a VELCRO-backed flap that folds perpendicularly with respect to the direction of extension of the zipper track and folds from a side wall of the enclosure to overlying the bottom surface or underside of the enclosure.

SUMMARY OF THE INVENTION

The present invention relates to a mattress protector with improved moisture management and bed bug containment. It is also applicable to protect box springs. The present invention includes the following interrelated objects, aspects and features:

(1) In a first aspect, the preferred embodiment of the present invention contemplates a mattress protector that completely encloses a mattress and seals the mattress from outside the protector to preclude bed bugs from escaping. The mattress protector includes a top wall, a bottom wall and, in a preferred embodiment, side walls with adjacent walls perpendicular to one another. Each wall has an outer surface and an inner surface. To facilitate protection, all of the interior or inner surfaces of the protector which face the outer surfaces of the mattress or box spring are coated or laminated with a film laminate that is strongly resistant to bed bug bites. One example of such a film laminate is one made of polyethylene film. The seams between sides and top and bottom walls are taped to prevent bed bug escape through gaps in sewn seams.

(2) The mattress protector, in the preferred embodiment, includes a zipper that extends to partially around the circumference of the mattress protector over three of the sides so that when the zipper is opened an opening is provided allowing a mattress or box spring to be slid into the protector. In the preferred embodiment, the zipper is located next to or at the intersection between side walls and the bottom wall of the mattress protector.

(3) As part of the structure precluding bed bugs from escaping the interior of the mattress protector, at the end of the zipper where it completely closes the mattress protector, a closure flap is provided that extends perpendicularly to the direction of extension of the zipper. The flap is attached at a side wall of the mattress protector and when closed extends downward over the zipper slide and then overlies the intersection between the side wall and bottom wall, extending under the bottom wall and being fastened there by suitable means such as two halves of a hook and pile fastening means.

(4) Alternatively, the flap may be attached at the bottom wall of the mattress protector and extend over the zipper slide and be fastened using suitable means such as hook and pile fastening means located on the side wall of the mattress protector.

(5) The top wall of the mattress protector is well-spaced from the zipper by the side walls of the mattress protector. The top wall of the mattress protector faces the sheets on which the bed user will lie. The outer surface of the top wall is preferably provided with a coating such as is disclosed by Marte et al. (as explained above) that renders the top surface waterproof while also providing anti-microbial properties. The coating on top also provides unique temperature regulation.

(6) The temperature regulation preferably is designed to interact with perspiration of the bed user to great advantage. For example, as disclosed by Marte et al. ([0076]), the coating may bind to water or liquid such as perspiration at temperatures less than 30° C. and may precipitate water or such liquid at higher temperatures due to increasing insolubility. Since released water quickly evaporates corresponding to the ambient conditions and energy is thereby removed by evaporation enthalpy applied to the system, the fabric of the top surface is cooled and the skin of the user is correspondingly cooled since the effect of the coating is felt through the bedding sheets.

(7) Where liquids are present, an attractive environment for bacterial growth exists. Thus, the anti-microbial properties of the top coating of the mattress protector substantially preclude growth of any bacteria that may be or become present on the mattress protector, thus protecting the user(s) from diseases resulting from contact with bacteria as well as eliminating odors caused by proliferation of bacteria. The anti-microbial aspect may consist of a silver-based solution applied to the top surface of the mattress protector having bacteriostatic properties that inhibit the growth of odor-causing bacteria. As should be evident, the anti-microbial coating not only inhibits disease formation, but also reduces or eliminates odors that are typically found in bedding products after they have been used for a period of time.

(8) In one embodiment of the present invention, the top surface of the mattress protector may be made of a polyester-nylon peachy twill blend having a thread count in the range of 200 to 300 threads per inch. Of course, other thread counts may suitably be employed. The coatings incorporated into the teachings of the present invention, when applied, wrap around the threads of the mattress protector encompassing those threads and isolating them within the coating. Other materials for the top wall of the mattress protector may be employed such as, for example, pure cotton, polyester or cotton blends in both woven and knit constructions. The coating on the top surface including anti-microbial and temperature regulating properties may be made from a thermoplastic polyurethane laminate providing an allergen resistant waterproof barrier on which the HeiQ® Adaptive and HeiQ® Pure coatings may be applied.

(9) The bottom wall and side walls may be made of a different fabric from that of the top wall. One example of such a fabric could be a 100% polyester knit with the barrier described above consisting of a laminated polyethylene film. Of course, if desired, the same materials may be used for all six sides of the mattress protector, however, it is not necessary for the side walls and bottom wall to be made of the same kind of fabric as is the case for the top wall.

(10) In the preferred embodiment, all interior seams are taped to completely seal the interior of the mattress protector to preclude bed bugs from escaping. The taping that is employed is quite strong and does not provide a weak point for bed bug escape.

Accordingly, it is a first object of the present invention to provide a mattress protector with improved moisture management and bed bug containment.

It is a further object of the present invention to provide such a mattress protector in which the interior is completely laminated and taped to prevent bed bug escape.

It is a still further object of the present invention to provide such a mattress protector in which the zipper has its closed end protected from bed bug escape by virtue of a flap extending perpendicularly to the direction of extent of the zipper track.

It is a still further object of the present invention to provide such a mattress protector in which the flap described above extends along a side wall and to the underside of the mattress protector.

It is a yet further object of the present invention to provide a top wall of the mattress protector with temperature balancing and anti-microbial properties.

It is a still further object of the present invention to provide such a mattress protector in which the anti-microbial and temperature balancing coating wraps around the threads of the top wall fabric to substantially completely enclose those threads.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 7:
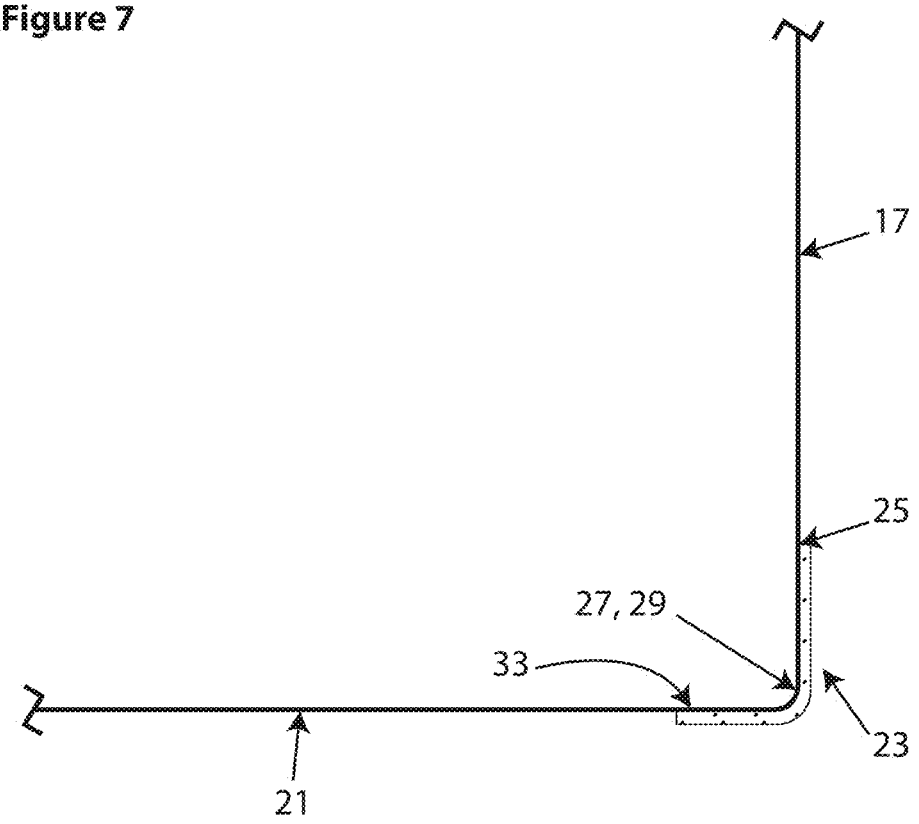
FIG. 7 shows a side view of the mattress protector showing the manner by which the flap overlies a side wall and the bottom wall of the mattress protector.

With reference first to FIGS. 1-4, the inventive mattress protector is generally designated by the reference numeral 10, and is seen to include a top wall 11, side walls 13, 15, 17 and 19, and a bottom wall 21. FIG. 7 shows the relationship between the side wall 17 and bottom wall 21. The side wall 17 is where the flap 23 is affixed at 25. The mattress protector 10 surrounds and encloses mattress 1. Alternatively, if desired, the flap 23 may be affixed to the bottom wall 21 and releasably fastened to a side wall.

Zipper tracks 27, 29 are located at the intersection of the side walls 13, 15 and 17 on the one hand, and the bottom wall 21 on the other hand. This is also shown with reference to FIG. 2. The zipper includes a zipper slide 31 shown in FIG. 1 with the zipper slide pulled to the complete open position.

Figure 5:
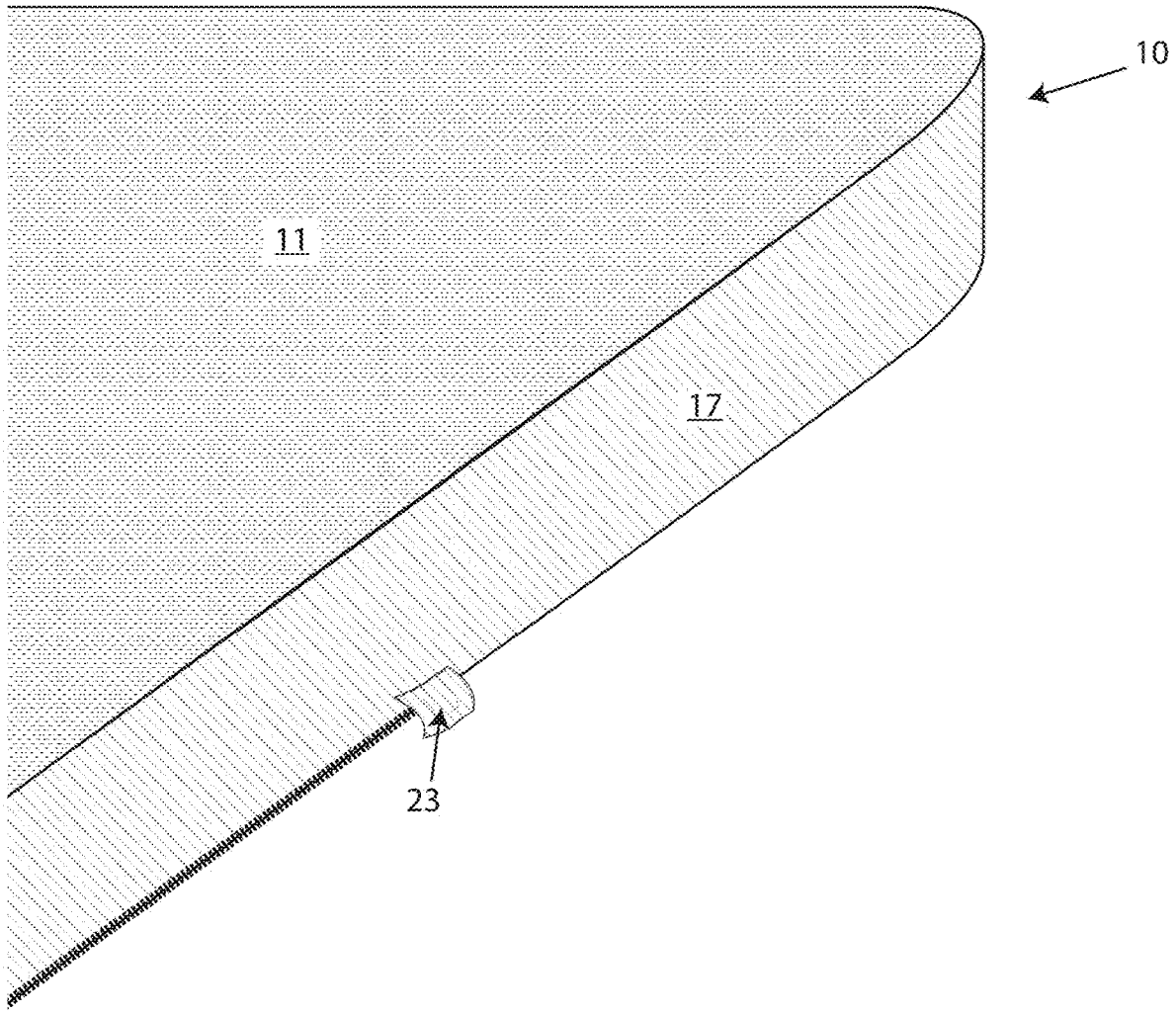
FIG. 5 shows details of the flap covering the zipper pull at the end of the zipper.
Figure 6:
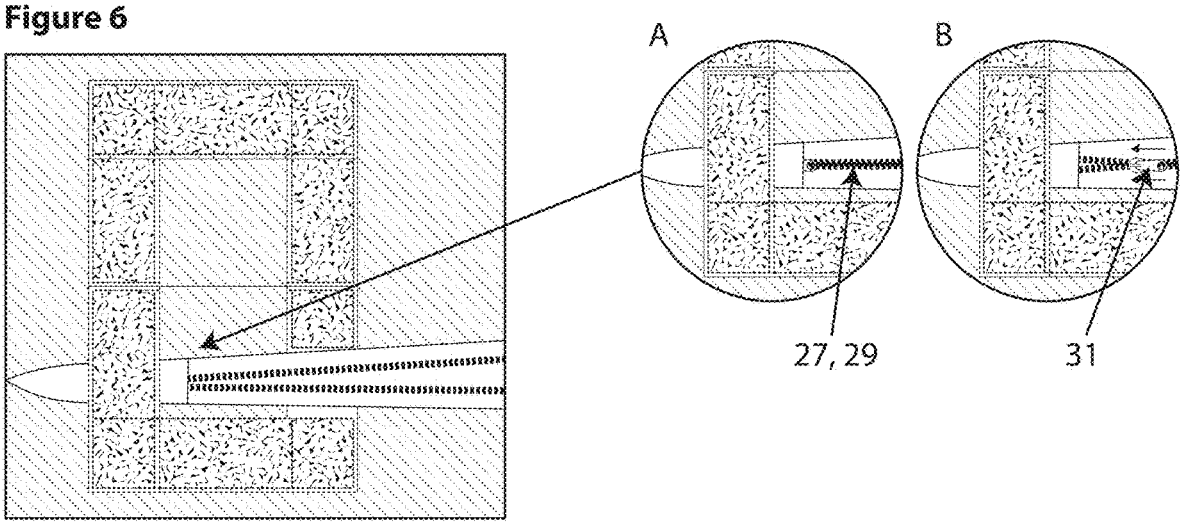
FIG. 6 shows further details of the flap.

With reference to FIGS. 5 and 6, the flap 23 is seen on the side wall of the mattress protector 10 and the two circular enlargements A and B show the scenario when the zipper is closed and opened, respectively. The image B shows the zipper slide 31 as it approaches the end of the zipper tracks 27, 29. As understood from FIGS. 5 and 7, the flap 23 folds over the zipper tracks with the zipper slide 31 at the end of the tracks and affixes on the bottom wall 21 at the reference numeral 33 by virtue of complementary hook and pile fastener halves which fasten the end of the flap 23 in the manner shown in FIG. 7. Of course, other fastening means may be employed such as, for example, releasable adhesives as well as snaps in two examples. As explained above, if desired, the flap 23 may be affixed to the bottom wall 21 and releasably fastened to the side wall 17.

Figure 1:
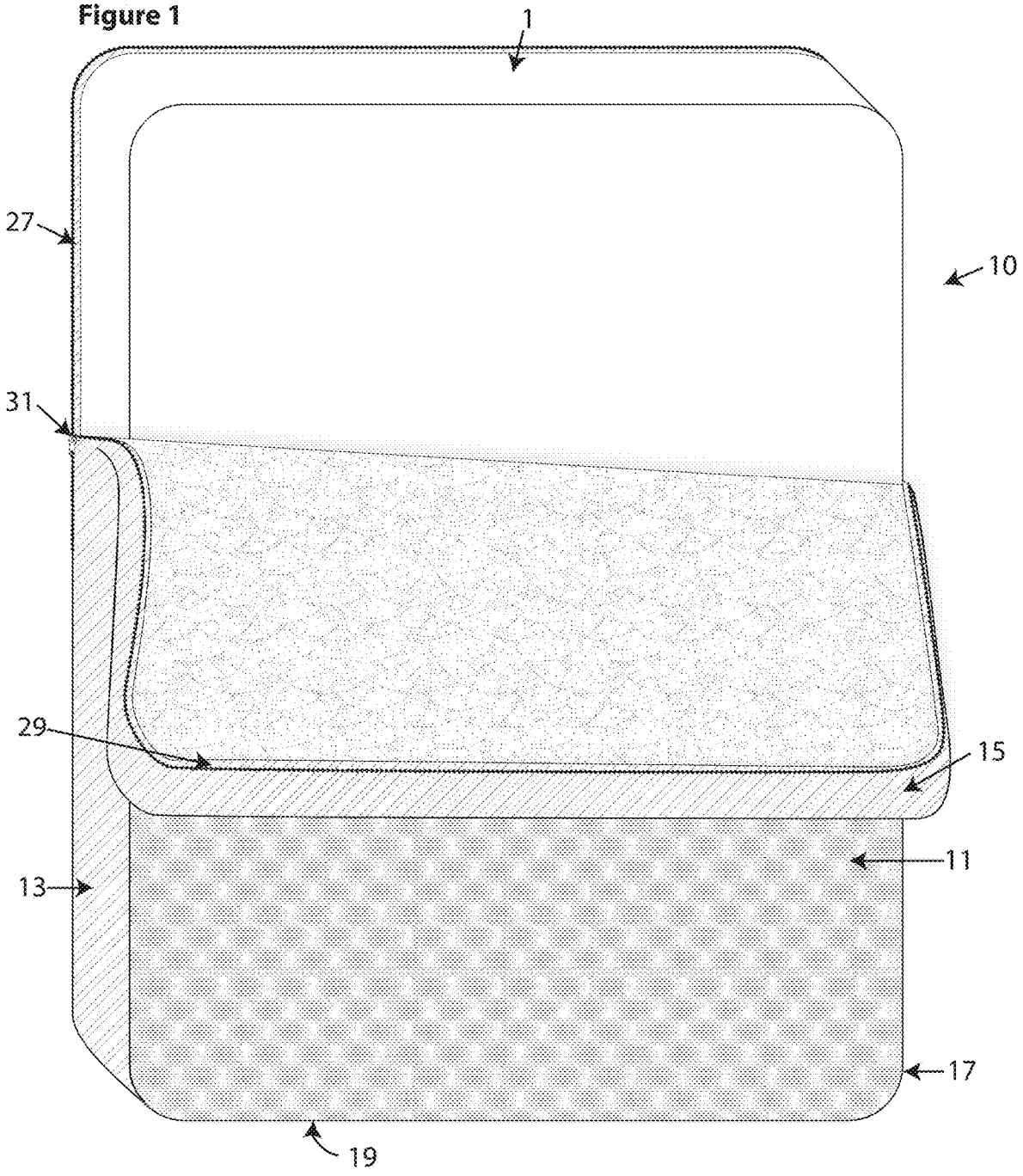
FIG. 1 shows a top view of the inventive mattress protector enclosing a mattress but with its zipper opened and the top surface peeled back to show detail.
Figure 2:
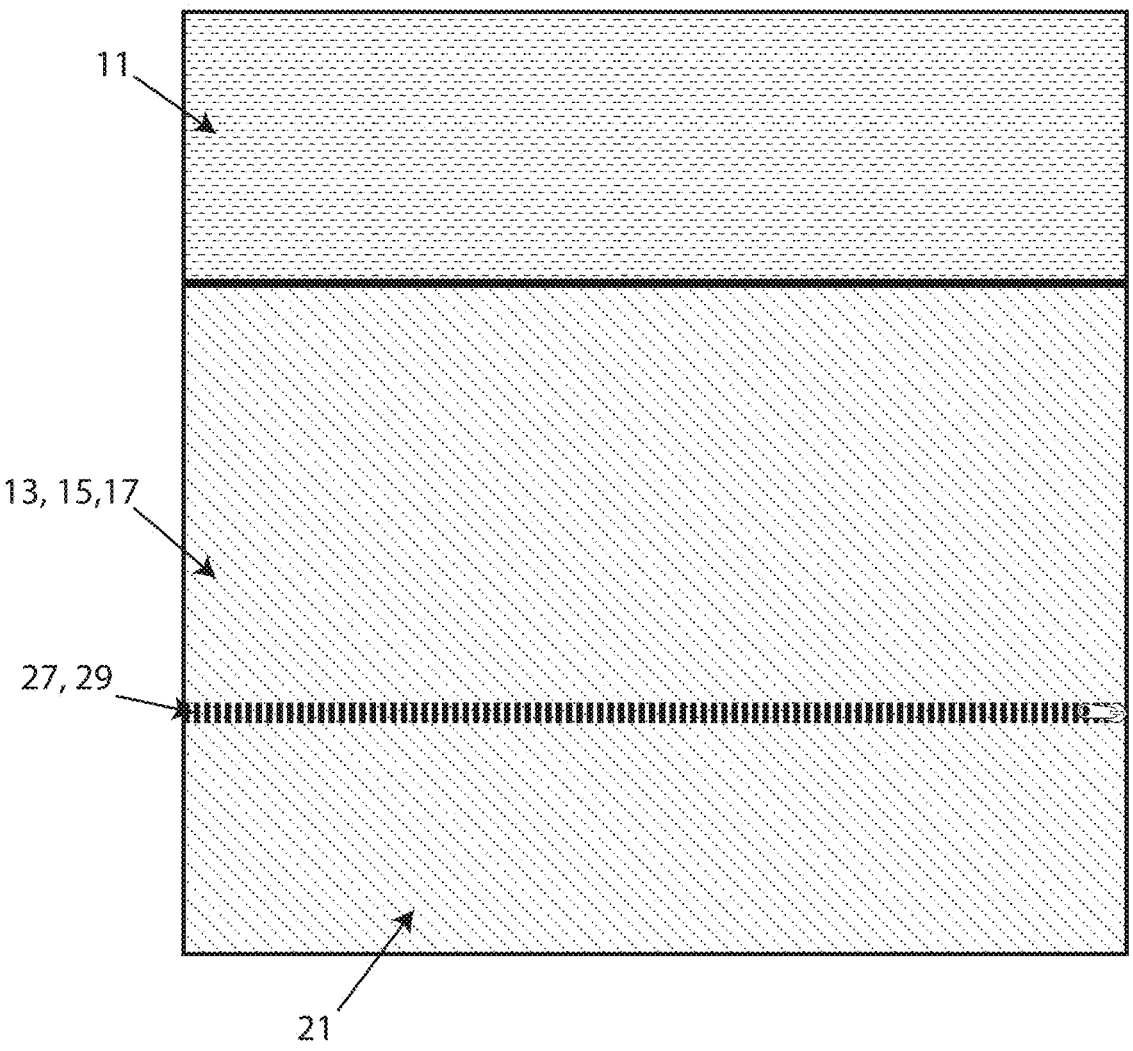
FIG. 2 shows the exterior of the inventive mattress protector unfolded to show the relationship between the top, side and bottom walls.
Figure 3:
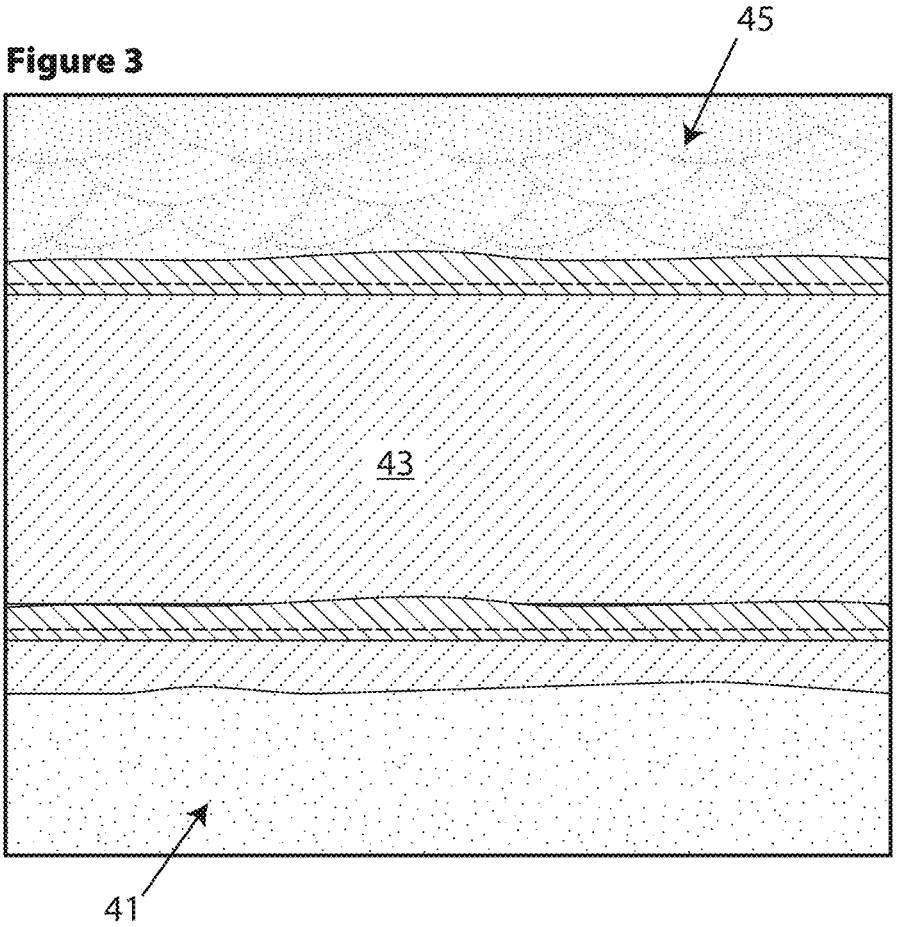
FIG. 3 shows the interior of the inventive mattress protector unfolded to show the details of the interior surfaces of the top, side and bottom walls.
Figure 4:
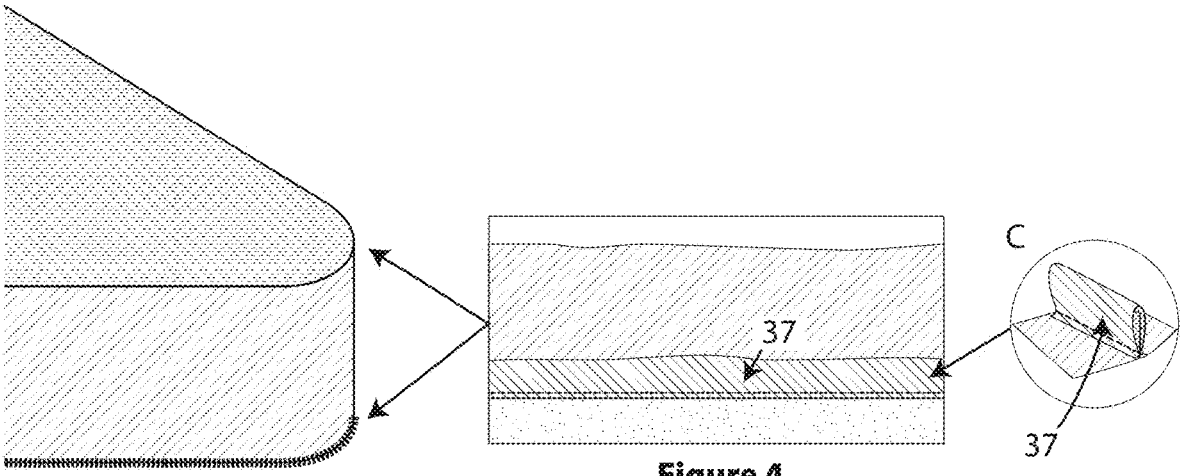
FIG. 4 shows details of the zipper location as well as the manner by which the seams are taped in the interior.

With reference to FIGS. 3 and 4, the seams between the top wall, side walls, and bottom wall are taped with taping 37 best seen in the circular image C forming a part of FIG. 4. This taping 37 acts to completely hermetically seal the interior of the mattress protector 10 when the zipper is completely closed and the flap 23 is in the position shown in FIG. 7. In this way, the interior is isolated from the exterior. The taping 37 resists damage from bites of bed bugs and prevents bed bug escape through gaps in sewn seams.

A laminate 41, 43, 45 is laminated over all of the interior surfaces of the top, side and bottom walls of the inventive mattress protector 10. The laminate is chosen to be impervious to bed bug bites so that bed bugs cannot bite through the mattress protector and escape. One preferred material for this hermetically sealing laminate is a polyethylene film laminated on all of the six noted surfaces.

Thus, the combination of the polyethylene film laminated on all six interior surfaces, the tape 37 sealed over all of the seams between the respective walls, the zipper with its track 27, 29 and slide 31, and the flap 23 combine together to hermetically seal the interior of the mattress protector 10 and prevent bed bugs from biting through the material or escaping via the zipper. In this way, the inventive mattress protector prevents bed bugs from escaping the interior of the mattress protector and biting users of the associated bed.

In the preferred embodiment of the present invention, recognizing that only the top surface of the top wall 11 of the mattress protector 10 will be supporting the people using the bed, the top wall 11 may be made of a material different than the material from which the side walls and bottom wall are made. In this regard, in one embodiment of the present invention, the bottom wall 21 and the side walls 13, 15, 17 and 19 may be made of a material such as a 100% polyester knit laminated on its interior walls with a polyethylene film as explained above. In a preferred embodiment, the top wall 11 may be made of a material such as a blend of polyester and nylon peachy twill weaved as desired. One possible blend could be 88% polyester and 12% nylon peachy with a thread count of 200 to 300 threads per inch, preferably 240 threads per inch. On the top surface of the wall 11, the surface facing the sheets, blankets, pillows, and users, a unique coating may be applied to enhance the performance characteristics of the mattress protector 10. In a first aspect, the coating may include anti-microbial properties intended to prevent odors from forming as a result of moisture that inherently collects on a mattress protector and also to do so by reducing or eliminating the multiplication of bacteria that cannot only cause odor but can cause disease. In the preferred embodiment, the anti-microbial coating may be one known as "HeiQ® Pure," a silver-based solution applied to the top surface of the top wall 11 as explained in the Marte et al. Published Application, referenced earlier.

Additionally, the top surface of the top wall 11 of the inventive mattress protector 10 is provided with a novel hydro-functional polymer film described as HeiQ® Adaptive, also disclosed in the Matte et al. Published Application. The HeiQ® Adaptive polymer film is possessed of temperature responsive moisture transport properties. Thus, for example, at temperatures greater than 30° C., at which cooling is desirable, its wetting and evaporation are enhanced. At lower temperatures such as below 30° C., when cooling is less needed, wetting and evaporation are reduced. The cooling properties are based upon facilitating evaporation of moisture emitted from the skin of a person occupying the associated bed.

In more detail, the temperature responsive polymer film binds to water at lower body temperatures such as below 30° C. and precipitates water at higher temperatures due to the increasing insolubility. Since the released water more or less quickly evaporates corresponding to the prevailing conditions and energy is removed by the evaporation enthalpy that is to be applied to the system, the result is cooling of the wall 11, particularly its top surface, and thus the skin of the person or persons occupying the associated bed.

Figure 8:
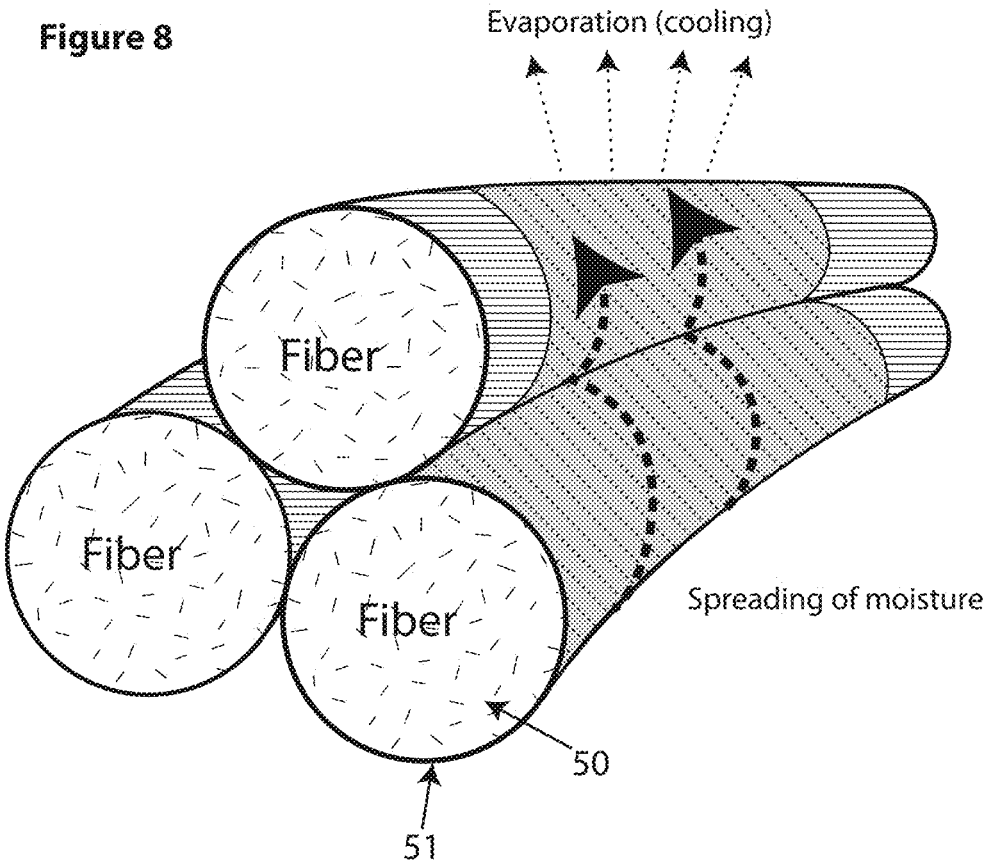
FIG. 8 shows a schematic representation of the manner by which the inventive coating envelops and encompasses the fibers of the mattress protector structure.

FIG. 8 shows an enlarged view of a portion of the textile employed for the top wall 11 of the inventive mattress protector 10. In FIG. 8, the reference numeral 50 refers to one of the numerous fibers woven to form the top wall 11. The reference numeral 51 refers to the coating of the hydro-functional polymer film and anti-microbial coating which as clearly seen envelop the entirety of the external surfaces of the fibers 50 and thereby encloses them and isolates them from the atmosphere so that it is the coating 51 itself that is exposed to ambient temperature conditions, conditions of sweat and liquid, and other ambient conditions.

The features of the inventive mattress protector 10 combine together to provide the ultimate in mattress protection as well as in comfort and odor reduction as well as disease prevention for users of the associated bed. The hermetic sealing of the interior surfaces of the mattress protector in the manners described above absolutely prevent any bed bugs from leaving the interior chamber formed by the mattress protector 10. The flap that covers the zipper overlies a side wall and the bottom wall of the mattress protector 10 in a unique and novel manner. Use of anti-microbial coating protects the users of the associated bed from odors as well as from proliferation of disease causing bacteria. The temperature balancing coating provides the users of the associated bed with an enhanced degree of comfort maintaining comfortable temperatures within the bed through interaction between the coating and the sweat production of the users, taking into account ambient temperatures and temperatures within the bed.

As such, an invention has been disclosed in terms of a preferred embodiment thereof which fulfills each and every one of the objects of the invention as set forth hereinabove, and provides a new and useful mattress protector with improved moisture management and bed bug containment of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A bedding protector, comprising:

a) a plurality of walls including a top wall, a bottom wall, and at least one side wall, each wall having an outer surface and an inner surface;

b) said inner surfaces being laminated with a bed bug impervious laminate;

c) intersections between adjacent walls being sealed to preclude bed bug escape;

d) said inner surfaces combining to create an inner chamber;

e) an opening formed at or adjacent an intersection between said bottom wall and said at least one side wall, said opening sized to facilitate receiving bedding, comprising a mattress or box spring, within said inner chamber, and a zipper including opposed tracks on facing faces of said opening, said zipper including a slide movable between a first position at which said opening is completely open and a second position at which said opening is completely closed;

f) said outer surface of said top wall being coated with a coating enveloping substantially the entirety of external surfaces of fibers forming said top wall, said coating interacting with liquid, whereby below a threshold temperature said coating binds to liquid and above said threshold temperature said coating precipitates liquid, said coating also having anti-microbial properties that suppress bacteria growth.

2. The bedding protector of claim 1, wherein said bedding comprises a mattress or box spring of substantially rectangular cubic dimensions and said inner chamber is shaped to conform to said dimensions of said mattress or box spring.

3. The bedding protector of claim 1, wherein said intersections between adjacent walls are sealed with bed bug impervious sealing tape.

4. The bedding protector of claim 3, wherein said bed bug impervious laminate comprises a polyethylene film.

5. The bedding protector of claim 1, wherein at said second position of said zipper slide, a flap extends between said at least one side wall and said bottom wall and covers said zipper slide.

6. The bedding protector of claim 5, wherein said flap is attached to said at least one side wall and removably attached to said bottom wall.

7. The bedding protector of claim 6, wherein said flap is removably attached to said bottom wall by complementary halves of a hook and pile fastener.

8. The bedding protector of claim 7, wherein said flap extends substantially perpendicularly to a direction of extent of said zipper tracks.

9. The bedding protector of claim 1, wherein said threshold temperature is 30° C.

10. The bedding protector of claim 1, wherein said at least one side wall comprises four walls with adjacent side walls being substantially perpendicular to one another.

11. The bedding protector of claim 10, wherein said opening is formed in only three of said side walls.

12. The bedding protector of claim 1, wherein said top wall is made of a polyester-nylon peachy twill blend having a thread count in a range of 200 to 300 threads per inch.

13. The bedding protector of claim 12, wherein said bottom wall and at least one side wall are made of a polyester knit material.

14. The bedding protector of claim 1, wherein said anti-microbial properties of said coating suppress odors.

15. The bedding protector of claim 1, wherein said liquid comprises human perspiration.

16. A mattress protector, comprising:

a) a plurality of walls including a top wall, a bottom wall, and four side walls, each wall having an outer surface and an inner surface;

b) said inner surfaces being laminated with a bed bug impervious laminate;

c) intersections between adjacent walls being sealed with tape to preclude bed bug escape;

d) said inner surfaces combining to create an inner chamber;

e) an opening formed at or adjacent an intersection between said bottom wall and three of said side walls, said opening sized to facilitate receiving a mattress within said inner chamber, and a zipper including opposed tracks on facing faces of said opening, said zipper including a slide movable between a first position at which said opening is completely open and a second position at which said opening is completely closed;

f) said outer surface of said top wall being coated with a coating enveloping substantially the entirety of external surfaces of fibers forming said top wall, said coating interacting with liquid, whereby below a threshold temperature said coating binds to liquid and above said threshold temperature said coating precipitates liquid, said coating also possessing anti-microbial properties to deter propagation of bacteria and suppress odors, and g) at said second position of said zipper slide, a flap extends between one of said side walls and said bottom wall and covers said zipper slide.

17. The mattress protector of claim 16, wherein said top wall is made of a polyester-nylon peachy twill blend having a thread count in a range of 200 to 300 threads per inch, and said bottom wall and side walls are made of a polyester knit material.

18. The mattress protector of claim 16, wherein said bed bug impervious laminate comprises a polyethylene film.

19. The mattress protector of claim 16, wherein said flap extends substantially perpendicularly to a direction of extent of said zipper tracks.

20. The mattress protector of claim 16, wherein said threshold temperature is 30° C.

* * * * *